US006655367B2

(12) United States Patent
Ohkama et al.

(10) Patent No.: US 6,655,367 B2
(45) Date of Patent: Dec. 2, 2003

(54) PLUG-HOLE-INSTALLED IGNITION COIL UNIT FOR INTERNAL COMBUSTION ENGINES

(75) Inventors: Toshihiro Ohkama, Wako (JP); Yoshihito Ozawa, Wako (JP); Kazuyuki Kubo, Wako (JP); Kenichi Ishida, Wako (JP); Gakuji Moriya, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,384

(22) Filed: Jun. 26, 2002

(65) Prior Publication Data

US 2003/0005914 A1 Jan. 9, 2003

(30) Foreign Application Priority Data

Jul. 3, 2001 (JP) ..... 2001-202592

(51) Int. Cl.[7] ..... F02P 7/077

(52) U.S. Cl. ..... 123/634; 123/635; 123/630; 123/647

(58) Field of Search ..... 213/630, 635, 213/634, 647; 361/704, 705, 718, 719; 324/402

(56) References Cited

U.S. PATENT DOCUMENTS

| | | | | | |
|---|---|---|---|---|---|
| 5,144,935 | A | * | 9/1992 | Taruya et al. | 123/633 |
| 5,146,906 | A | * | 9/1992 | Agatsuma | 123/634 |
| 5,377,652 | A | * | 1/1995 | Noble et al. | 123/634 |
| 5,487,676 | A | * | 1/1996 | Maruyama et al. | 439/125 |
| 5,632,259 | A | * | 5/1997 | Konda et al. | 123/634 |
| 5,706,792 | A | * | 1/1998 | Boyer et al. | 123/634 |
| 6,308,696 | B1 | * | 10/2001 | Kondo et al. | 123/634 |
| 6,378,514 | B1 | * | 4/2002 | Kaminaga et al. | 123/633 |
| 6,456,181 | B2 | * | 9/2002 | Nakamura | 336/96 |
| 6,463,918 | B1 | * | 10/2002 | Moga et al. | 123/633 |
| 6,484,708 | B2 | * | 11/2002 | Hirakawa et al. | 123/647 |
| 2003/0006744 | A1 | * | 1/2003 | Ohkama et al. | 324/382 |
| 2003/0037745 | A1 | * | 2/2003 | Moga et al. | 123/143 C |
| 2003/0038635 | A1 | * | 2/2003 | McQueeney et al. | 324/388 |

FOREIGN PATENT DOCUMENTS

| | | | | |
|---|---|---|---|---|
| JP | 63-120863 | | 5/1988 | |
| JP | 125167 | * | 5/1999 | F02P/17/12 |
| JP | 277232 | * | 10/2000 | F02P/13/00 |

* cited by examiner

*Primary Examiner*—Henry C. Yuen
*Assistant Examiner*—Hai Huynh
(74) *Attorney, Agent, or Firm*—Arent Fox Kintner Plotkin & Kahn, PLLC

(57) ABSTRACT

An ignition coil unit to be installed in a hole opened through a cylinder head of an engine having a case, an ignition coil installed in the case and comprising a primary coil connected to a power source and a secondary coil connected to a spark plug which is installed in a combustion chamber of a cylinder of the engine for producing spark discharge to ignite air-fuel mixture to generate combustion thereof in the combustion chamber, and a circuit board on which an ionic-current detection circuit, connected to the secondary coil, which detects ionic-current that flows during the combustion of the air-fuel mixture; and a processing circuit, connected to the ionic-current detection circuit, which generates an output indicative of the detected ionic-current, are formed; In the unit, an igniter is also installed in the case, thereby improving detection accuracy of ionic-current and misfiring.

5 Claims, 4 Drawing Sheets

PLUG-HOLE-INSTALLED IGNITION COIL UNIT FOR INTERNAL COMBUSTION ENGINES

BACKGROUND OF THE INVENTION

1. Field of the Invention

This invention relates to a plug-hole-installed ignition coil unit for internal combustion engines, particularly to an ignition coil unit installed in a hole opened through the engine cylinder head for direct ignition which houses a circuit board on which an ionic-current detection circuit and succeeding processing circuits for misfiring detection are formed.

2. Description of the Related Art

There have recently been proposed plug-hole-installed ignition coil units which are installed in a hole opened through engine cylinder head (so-called "plug hole"). Since such an ignition coil unit is installed in the plug hole, the coil unit is almost free from environmental influence such as moisture, oil, or any other foreign objects and can exhibit stable ignition performance. An example of the plug-hole-installed ignition coil unit is disclosed in Japanese Laid-Open Patent Application No. Sho 63 (1988)-120,863 in which a power transistor for switching operation of the primary coil is integrally housed so as to effect stable ignition performance in a reduced size.

In a gasoline or other spark-ignition internal combustion engine, a high voltage generated by the ignition coil is applied to spark plugs installed in the individual cylinders. The spark discharge that the high voltages produces across the gap between the spark plug electrodes ignites the air-fuel mixture, causing combustion. However, when certain causes are present during the engine ignition/combustion stroke, the combustion of the air-fuel mixture does not proceed normally, i.e., misfiring occurs.

Causes of misfiring fall in two classes, those attributable to the fuel supply system and those attributable to the ignition system. Misfiring attributable to the fuel supply system is the result of either excessively lean or excessively rich air-fuel mixture. In this case, a spark discharge is produced across the gap of the spark plug but the air-fuel mixture does not ignite. Misfiring attributable to the ignition system is the result of spark plug fouling (smoldering) caused by deposits of soot, etc., or of a problem in the ignition circuit that prevents normal spark discharge (mis-sparking).

When the air-fuel mixture burns normally, the combustion is accompanied by ionization of the air-fuel mixture (more precisely the combustion gas produced by normal burning of the air-fuel mixture) that gives rise to ionic-current. When misfiring occurs and the air-fuel mixture does not burn, the air-fuel mixture does not ionize and no ionic-current arises. A widely used method of detecting misfiring has therefore been to detect the ionic-current occurring during the combustion stroke using the spark plug as a probe for ionic-current detection and comparing the detected value with a prescribed value.

When conducting the misfire detection using this plug-hole-installed ignition coil unit, the ignition coil unit would normally be separated from the ionic-current detection circuit and other processing circuit and be connected by a cable or wire. That would degrade the accuracy of ionic-current detection and misfire detection. To be more specific, since the ionic-current resulting from combustion can be present for a extremely small period of time after ignition, the detection must be implemented at a fixed timing in a prescribed period of time.

However, if the ignition coil unit is connected to the circuits by a cable or wire, the detection accuracy of ionic-current and misfiring could be degraded by environmental influence. Specifically, the resistance in the cable or wire could be varied with the change in environmental temperature. The stray capacity of the wire or cable may be affected by moisture, oil or foreign conductive materials deposited thereon. The capacity in the circuit capacitors may also be varied by these factors. When these happen, it makes difficult to conduct the detection at a fixed timing in a prescribed period of time.

Moreover, when the ignition coil unit and the circuits are connected by a wire or cable, since the flowing current could rise up to 30 kV, it may become necessary to take some countermeasures against this high voltage by, for example, using a high-tension code. In addition, this high voltage current flow may generate noise in other electronic units.

SUMMARY OF THE INVENTION

A first object of the present invention is to overcome the aforesaid problems and to provide a plug-hole-installed ignition coil unit having an improved detection accuracy of ionic-current detection and misfiring.

A second object of the present invention is to provide a plug-hole-installed ignition coil unit which does no longer require to take high-voltage countermeasurement and can avoid generation of noise in other electronic units.

For achieving the first object, this invention provides a n ignition coil unit to be installed in a hole opened through a cylinder head of an engine, comprising: a case; an ignition coil installed in the case and comprising a primary coil connected to a power source and a secondary coil connected to a spark plug which is installed in a combustion chamber of a cylinder of the engine for producing spark discharge to ignite air-fuel mixture to generate combustion thereof in the combustion chamber; and a circuit board on which an ionic-current detection circuit, connected to the secondary coil, which detects ionic-current that flows during the combustion of the air-fuel mixture; and a processing circuit, connected to the ionic-current detection circuit, which generates an output indicative of the detected ionic-current, are formed; wherein the improvement comprises: the circuit board is installed in the case with the ignition coil.

BRIEF DESCRIPTION OF THE DRAWINGS

These and other objects and advantages of the invention will be made more apparent with reference to the following description and drawings, in which.

DETAILED DESCRIPTION OF THE PREFERRED EMBODIMENT

A plug-hole-installed ignition coil unit according to an embodiment of the present invention will now be explained with reference to the attached drawings.

Figure 1:
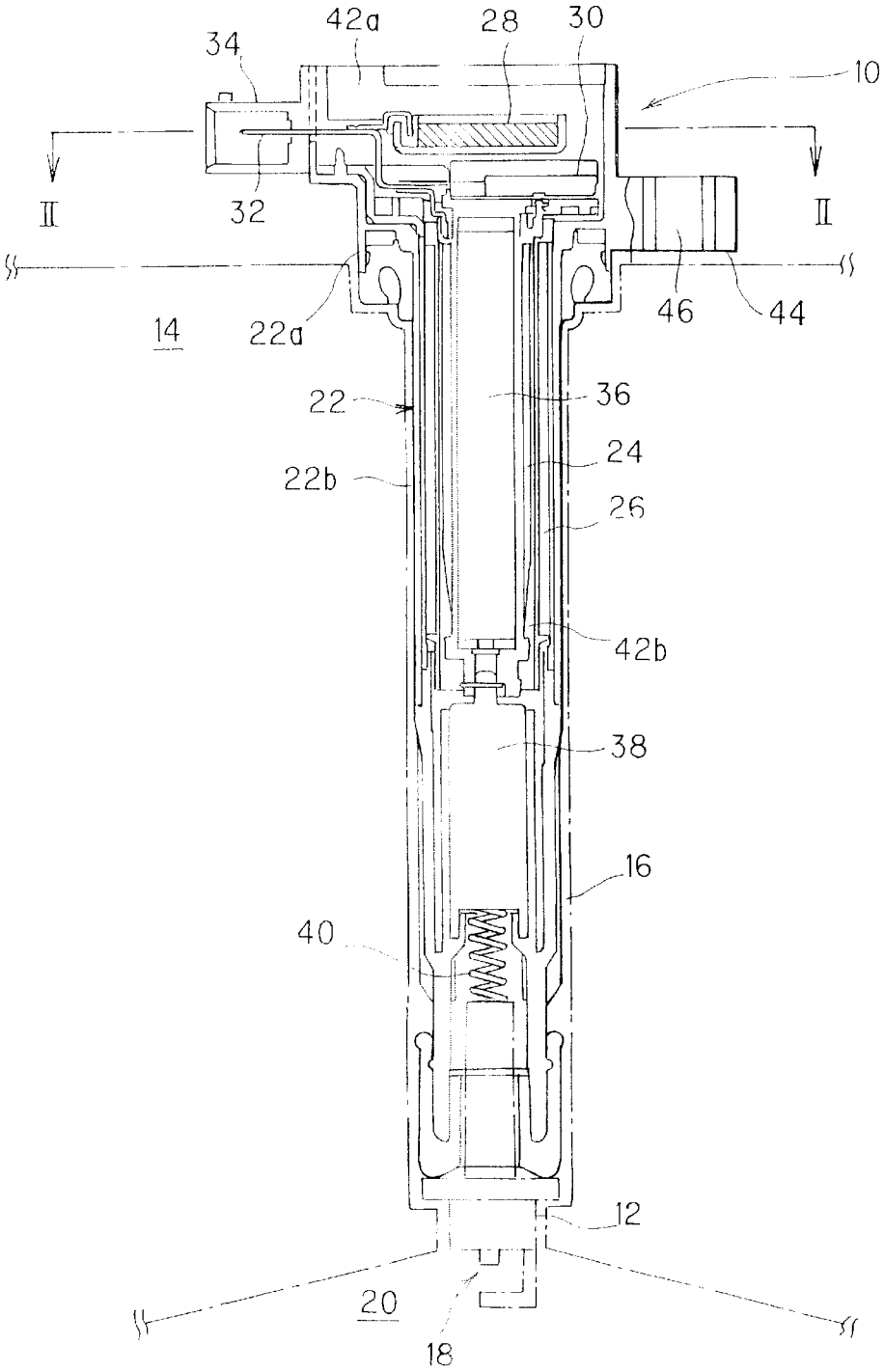
FIG. 1 is a sectional view of a plug-hole-type ignition coil unit according to an embodiment of the invention.

FIG. 1 is a sectional view of a plug-hole-type ignition coil unit according to the embodiment.

In the figure, reference numeral 10 indicates the plug-hole-installed ignition coil unit (hereinafter referred simply to the "ignition coil unit"), which has a spark plug 12 (shown by phantom lines). A cylinder head (partly shown) 14 of a spark ignition internal combustion engine (not completely shown) mounted on a vehicle (not shown) is opened by a cylindrical plug hole (hereinafter referred simply to the "hole") 16.

The ignition coil unit 10 is inserted in the hole 16 and is installed there in such a way that electrodes 18 of the spark plug 12 is located in a combustion chamber (partly shown) 20 of the engine. In the figure, the ignition coil unit 10 is housed in the hole 16 with a gap. However, this is for ease of understanding and in fact, the ignition coil unit 10 is tight-fitted in the hole 16. Thus, the ignition coil unit 10 is a plug-hole-installed ignition coil unit for internal combustion engine for direct ignition.

The ignition coil unit 10 includes a case or housing 22 which houses an ignition coil comprising a primary coil 24 and a secondary coil 26, a circuit board or unit 28 and an igniter 30. On the circuit board 28, there are mounted an ionic-current detection circuit for ionic-current detection and a processing circuit connected to the ionic-current detection circuit 28*a* for inputting output therefrom to generate an output indicative of the ionic-current. The igniter 30 supplies a signal to the primary coil 24 to generate a high voltage. Thus, the ignition coil unit 10 has the circuit board 28 and the igniter 30 which are installed or housed in the case 22 integrally with the ignition coil.

Figure 2:
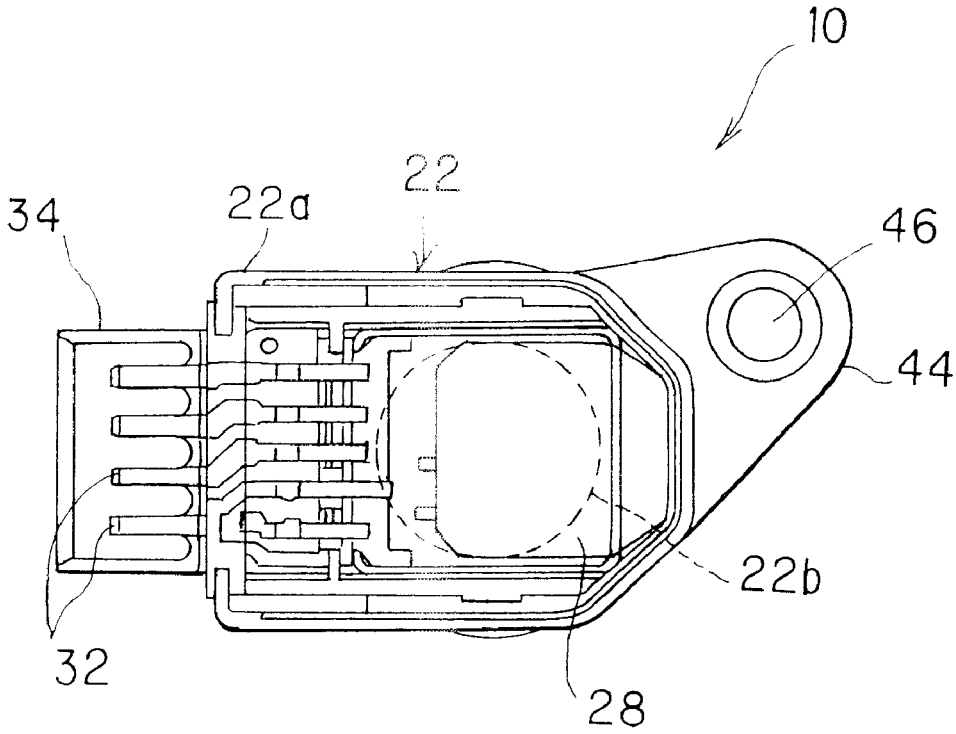
FIG. 2 is a cross-sectional view taken along lines II—II in FIG. 1.

Continuing explanation of the ignition coil unit 10 referring sometimes to FIG. 2 which is a cross-sectional view taken along line II—II in FIG. 1, the case 22 is made of a hard plastic material such as PBT (Polybutylenetherephthalate) and as shown in FIG. 2, it has a rectangular section 22*a* which is in the shape of rectangle when viewed from top and a cylindrical section 22*b* which is in an elongated narrow cylindrical shape and extends continually from the rectangular section 22*a*.

The case rectangular section 22*a* houses the circuit board 28 and the igniter 30. At one end, the case rectangular section 22*a* is provided with a connector 34 that has a plurality of pins 32. The pins 32 are connected, at one end, to the circuit board 28 and the igniter 30 and are connected, at the other end, to an ECU (Electronic Control Unit) and a power source (on board battery.)

Although the illustration of the ECU (and the power source) is omitted in FIGS. 1 and 2, the ECU comprises a microcomputer having a CPU, a ROM, a RAM and input/output circuits, etc. It is inputted with the outputs of a group of sensors, including a crank angle sensor that is installed near the crankshaft or camshaft of the engine and outputs a signal representing the TDC (Top Dead Center) of the individual cylinders and unit crank angles (obtained by dividing the interval between the TDCs), a manifold absolute pressure sensor that outputs a signal representing the absolute pressure (PBA) in the air intake pipe, and other sensors. The ECU outputs an ignition signal to the circuit board 28 and the igniter 30 at a certain crank angular position. It also inputs the output indicative of the ionic-current generated by the circuit board 28 and based thereon, detects the misfiring occurred in the engine.

The ignition coil is stored in the case cylindrical section 22*b*. The ignition coil comprises a rounded iron core 36, the aforesaid primary coil 24 wound around on the iron core 36 and the aforesaid secondary coil 26 wound around on the primary coil 24. The primary coil 24 is connected, at one end, to the power source through the igniter 30 and the connector pin 32 and is grounded at the other end. The secondary coil 26 is connected, at one end, to a shaft 38 made of conductive material and is connected, at the other end, to the circuit board 28 (more precisely, to the ionic-current detection circuit). The shaft 38 is connected, at its distal end, to the aforesaid spark plug 12 through a spring 40 similarly made of conductive material.

As mentioned above, the spark plug 12 is located in the combustion chamber 20 and ignites the air-fuel mixture in the combustion chamber 20 when supplied with a high voltage from the primary coil 26. Ionic-current resulting from the air-fuel mixture combustion is detected by the circuits mounted on the circuit board 28 through the spark plug 12 (more specifically the electrodes 18), the spring 40, the shaft 38 and the primary coil 26.

At the side of the case rectangular section 22*a*, there is provided a flange 44 which is in the shape of triangle when viewed from top as illustrated in FIG. 2. The flange 44 has a threaded hole 46 opened therethrough. The cylindrical section 22*b* is inserted in the hole 16 such that the electrodes 18 of the spark plug 12 face into the combustion chamber 20, and the rectangular section 22*a* is fastened on the cylinder head 14 by putting screws (not shown) in the threaded hole 46 and mated threaded hole formed at the cylinder head 14 and by tightening them. Thus, the ignition coil unit 10 is fixed on the cylinder head 14. A gap 42*a* in the case rectangular section 22*a* and a gap 42*b* in the case cylindrical section 22*b* are molded or filled with resin such as epoxy resin such that the inside of the case 22 including the circuit board 28 is shut out from the exterior.

The interconnection between the components and the configuration of the circuit board 28 will now be explained with reference to FIG. 3.

As illustrated in the figure, one end of the primary coil 24 is connected to a power source 48 and the other end is grounded. The igniter 30 including a power transistor (not shown) is connected in the current path between the one end of the primary coil 24 and the power source 48 or in the current path between the other end of the primary coil 24 and the ground. The igniter 30 is connected to the ECU (now assigned with reference numeral 50) through the connector pin 32 (not shown in FIG. 3).

One end of the secondary coil 26 is connected to the spark plug 12, more precisely the center electrode of the electrodes 18 and is then grounded. The other end of the secondary coil 26 is connected to the circuit board 28, more specifically an ionic-current detection circuit 28*a* mounted on the circuit board 28. The ionic-current detection circuit 28*a* includes an ionic-current detection capacitor 28*a*1 to be charged in the illustrated polarity by discharge current and a Zener diode 28*a*2 that regulates the charging voltage of the ionic-current detection capacitor 28*a*1, a diode 28*a*3 that prevents reverse current flow through which the Zener diode 28*a*2 is grounded, and a detection resistor 28*a*4 through which the ionic-current detection capacitor 28*a*1 is grounded On the circuit board 28, a processing circuit 28*b* is connected to the ionic-current detection circuit 28*a* at a junction between the capacitor 28*a*1 and the resistor 28*a*4. The processing circuit 28*b* has an integrating capacitor (not shown) that integrates the ionic-current inputted from the junction. The processing circuit 28*b* is connected to the ECU 50 through the connector pin 32 (not shown in FIG. 3) and sends the output indicative of the integrated value of the detected ionic-current. Since detailed configuration of the processing circuit 28*b* itself does not have a direct relationship with the gist of the present invention, no more explanation will be made.

Thus, in the ignition coil unit 10 according to the embodiment, since the circuit board 28 (on which ionic-current detection circuit 28*a* and the processing circuit 28*b* are mounted and formed) is installed in the case 12, more precisely in the rectangular section 12*a* of the case 12 integrally with the secondary coil 26 and molded by resin, no exterior wire or cable is needed to connect the secondary coil 26 with the ionic-current detection circuit 28*a*, and to connect the ionic-current detection circuit 28*a* with the processing circuit 28*b*, With this, it becomes possible to reduce the influence on the change in the resistance and stray capacity caused by the aforesaid environmental factors to a minimum extent, thereby enhancing the detection accuracy of ionic-current and misfiring.

Moreover, since the igniter 30 is installed in the case 12, more precisely in the rectangular section 12*a* of the case 12 integrally with the primary coil 24 and molded by resin, no exterior wire or case is needed to connect the igniter 30 with the primary coil 24. With this, it becomes possible to obtain stable ignition performance, thereby further enhancing the detection accuracy of ionic-current and misfiring.

The detection of ionic-current and misfiring will then be explained with reference to the same figure.

The flow of current from the power source 48 through the primary coil 24 is switched (turned ON and OFF) by the power transistor of the igniter 30 in response to the ignition command pulse sent from the ECU 50.

When the ignition command pulse is made from ON to OFF, i.e., when the current flow through the primary coil 24 is stopped by switching of the power transistor from ON to OFF, a high voltage of negative polarity is concurrently produced in the secondary coil 26. Discharge current therefore flows through the path of the spark plug 12→secondary coil 26→ionic-current detection capacitor 28*a*1 (or Zener diode 28*a*2)→diode 28*a*3 produces a spark discharge across the gap of the spark plug 12 (between the center electrode and ground electrode) that ignites or fires the air-fuel mixture in the cylinder combustion chamber 20 and causes combustion thereof.

The discharge current charges the capacitor 28*a*1 to the polarity as illustrated in the figure. When charged, this capacitor 28*a*1 functions as a current detection power source with a bias voltage for detecting ionic-current.

During the combustion of the air-fuel mixture set off by the spark discharge at the spark plug 12, the air-fuel mixture (more precisely the combustion gas produced by normal burning of the air-fuel mixture) ionizes. The ions produced migrate owing to the effect of the bias voltage of the ionic-current detection capacitor 28*a*1 and their resulting presence between the electrodes of the spark plug 12 lowers the electrical resistance between the electrodes. As a result, ionic-current flows through the path of the ionic-current detection capacitor 28*a*1→secondary coil 26→spark plug 12. The ionic-current occurring at this time causes the voltage drop across the detection resistor 28 to change. The ionic-current detection circuit 28*a* outputs this voltage change to the processing circuit 28*b* which generates the output indicative of integrated value of the ionic-current and sends the same to the ECU 50. The ECU 50 compares the detected output with a threshold value and detects whether misfiring has occurred in the engine. The integrating capacitor is discharged by the next ignition command pulse such that the output of the processing circuit 28*b* is resetted for next detection.

Thus, the ionic-current detection circuit 28*a* has the ionic-current detection capacitor 28*a*1 which plays a significant role in the ionic-current detection. Although not shown, the processing circuit 28*b* has a plurality of capacitors. As mentioned above, if the stray capacity in these capacitors varies, it becomes difficult to conduct the detection at a fixed timing in a prescribed period of time and this degrades the detection accuracy of ionic-current and misfiring. Since, however, the circuit board 28 including these circuits is housed within the case rectangular section 12*a* and the gap 42*a* therebetween is filled with resin, the stray capacity in the capacitors in the circuits can remain unchanged.

Figure 3:
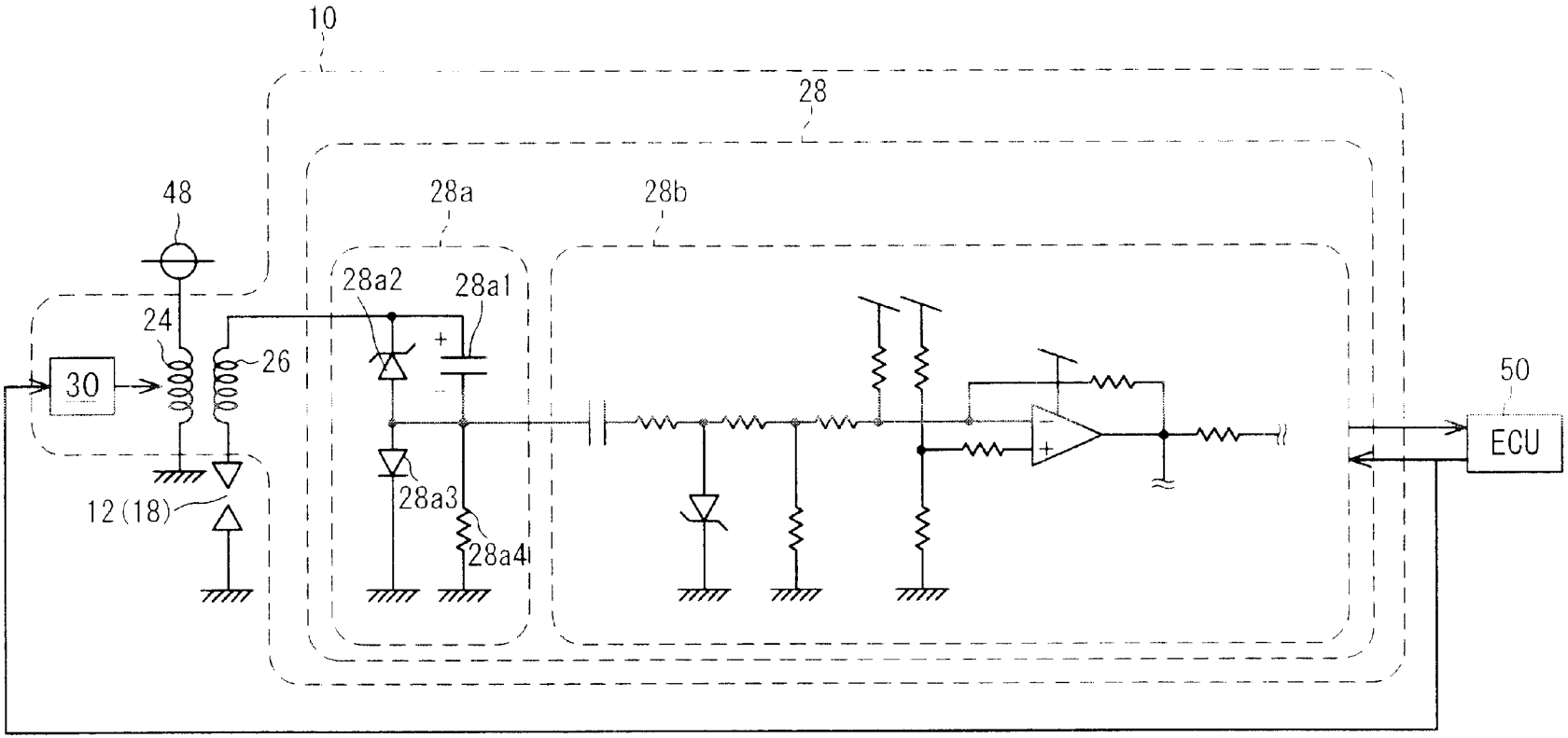
FIG. 3 is a circuit diagram showing the configuration of circuits formed on a circuit board of the ignition coil unit illustrated in FIG. 1.
Figure 4:
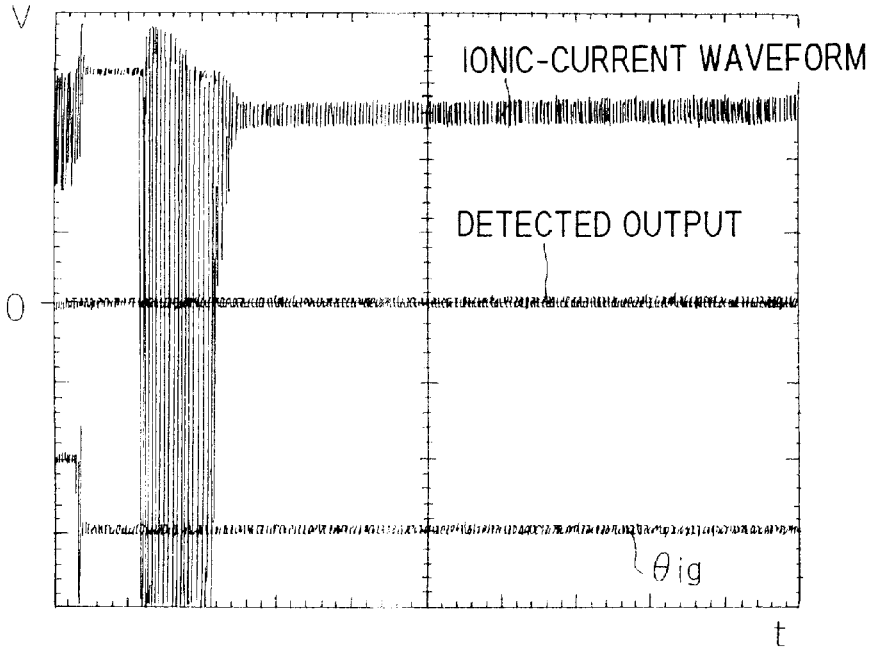
FIG. 4 is an experimental data showing output of the circuit on the circuit board illustrated in FIG. 3.
Figure 5:
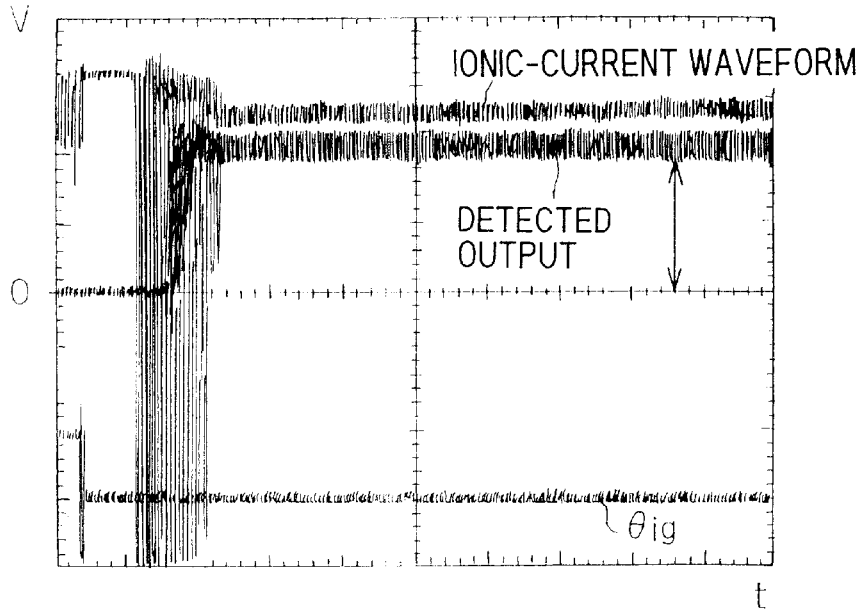
FIG. 5 is a view, similar to FIG. 4, but showing an experimental data obtained in a configuration where an ignition coil unit is assumed to be separated from the circuit board and to be connected by a wire or cable.

FIG. 4 is an experimental data showing detected output (aforesaid integrated value) of the processing circuit 28*b* illustrated in FIG. 3, and FIG. 5 is data similarly showing an experimental data obtained in a configuration where the ignition coil unit assumed to be separated from the circuit board 28 and to be connected by a wire or cable. The data illustrated in FIG. 5 is based on the condition that the wire or cable is wet. The data illustrated in FIGS. 4 and 5 are based on a condition in which misfiring occurred at engine speed of 1000 rpm under normal temperature.

Since misfiring occurred in the engine, the detected output must be zero as illustrated in FIG. 4. However, in the data in FIG. 5, the detected output is raised above zero due to the change in the stray capacity and resistance. If the raised output exceeds a threshold value for misfiring detection, it could be judged that the ionic-current is generated normally and no misfiring occurs. This will require to change the threshold value in response to the change in environment when the ignition coil unit and the circuit board are connected by a cable or wire.

Since, however, in the embodiment, the circuit board 28 is housed within the case rectangular section 12*a* and the gap 42*a* therebetween is filled with resin such that the stray capacity in the capacitors in the circuits can accordingly remain unchanged, it can improve the detection accuracy. In addition, this configuration can eliminate the countermeasure against high voltage and can avoid generation of noise in other electronic units.

Having been described in the foregoing, the embodiment is configured to have an ignition coil unit 10 to be installed in a hole 16 opened through a cylinder head 14 of an engine, comprising: a case 12; an ignition coil installed in the case and comprising a primary coil 24 connected to a power source and a secondary coil 26 connected to a spark plug 12 which is installed in a combustion chamber of a cylinder 20 of the engine for producing spark discharge to ignite air-fuel mixture to generate combustion thereof in the combustion chamber; and a circuit board 28 on which an ionic-current detection circuit 28*a*, connected to the secondary coil, which detects ionic-current that flows during the combustion of the air-fuel mixture; and a processing circuit 28*b*, connected to the ionic-current detection circuit, which generates an output indicative of the detected ionic-current, are formed. In the unit, the circuit board 28 is installed in the case 12 with the ignition coil.

The ignition coil unit 10 further includes; an igniter 30, connected to the primary coil, which outputs a signal to generate the spark discharge in the spark plug; and wherein the igniter is installed in the case with the ionic-current circuit. a gap 42*a* between the circuit board and the case is filled with resin, and a gap 42*a* between the igniter and the case is filled with the case. Further, a gap 42*b* formed around the ignition coil is filled with resin.

The entire disclosure of Japanese Patent Application No. 2001-202592 filed on Jul. 3, 2001, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. An ignition coil unit to be installed in a hole opened through a cylinder head of an engine, comprising:

a case having an upper section and a cylindrical section extending from the upper section and inserted in the hole;

an ignition coil installed in the cylindrical section of the case and comprising a primary coil connected to a power source and a secondary coil connected to a spark plug which is installed in a combustion chamber of a cylinder of the engine for producing spark discharge to ignite air-fuel mixture to generate combustion thereof in the combustion chamber; and a circuit board on which an ionic-current detection circuit, connected to the secondary coil, which detects ionic-current that flows during the combustion of the air-fuel mixture; and a processing circuit, connected to the ionic-current detection circuit, which generates an output indicative of the detected ionic-current, being formed, the circuit board being installed in the upper section of the case.

2. The ignition coil unit according to claim 1, further comprising:

an igniter, connected to the primary coil, which outputs a signal to generate the spark discharge in the spark plug, wherein the igniter is installed in the upper section of the case with the ionic-current circuit.

3. The ignition coil unit according to claim 2, wherein a gap between the igniter and the case is filled with resin.

4. The ignition coil unit according to claim 1, wherein a gap between the circuit board and the case is filled with resin.

5. The ignition coil unit according to claim 1, wherein a gap formed around the ignition coil is filled with resin.

* * * * *